US009217223B2

(12) United States Patent
Mannius Zu Dem Berge

(10) Patent No.: US 9,217,223 B2
(45) Date of Patent: Dec. 22, 2015

(54) METHOD FOR PREPARING A TEXTILE MATERIAL AND A TEXTILE MATERIAL THUS PREPARED AND PRODUCED

(76) Inventor: Patrick Johan Olof Ermes Mannius Zu Dem Berge, Falköping (SE)

( * ) Notice: Subject to any disclaimer, the term of this patent is extended or adjusted under 35 U.S.C. 154(b) by 1079 days.

(21) Appl. No.: 12/084,519

(22) PCT Filed: Oct. 30, 2006

(86) PCT No.: PCT/SE2006/001219
§ 371 (c)(1),
(2), (4) Date: Nov. 12, 2008

(87) PCT Pub. No.: WO2007/053076
PCT Pub. Date: May 10, 2007

(65) Prior Publication Data

US 2009/0074946 A1 Mar. 19, 2009

(30) Foreign Application Priority Data

Nov. 4, 2005 (SE) ..... 0502456

(51) Int. Cl.
*A61F 13/02* (2006.01)
*D06M 16/00* (2006.01)

(52) U.S. Cl.
CPC ..... *D06M 16/00* (2013.01)

(58) Field of Classification Search
USPC ..... 427/2.31, 249.2, 249.3, 255.24, 513, 427/538
See application file for complete search history.

(56) References Cited

U.S. PATENT DOCUMENTS

| | | | | |
|---|---|---|---|---|
| 5,091,318 | A * | 2/1992 | Anawis et al. | 436/513 |
| 5,122,452 | A | 6/1992 | Yamazaki et al. | |
| 5,874,164 | A | 2/1999 | Caldwell | |
| 2003/0108514 | A1 | 6/2003 | Lillard | |

FOREIGN PATENT DOCUMENTS

| | | |
|---|---|---|
| BE | 902932 | 11/1985 |
| DE | 196 50 496 | 4/1998 |
| EP | 0 451 800 | 10/1991 |

(Continued)

OTHER PUBLICATIONS

Espacenet English abstract of JP 5-188031.

(Continued)

*Primary Examiner* — Eisa Elhilo

(57) ABSTRACT

The present invention is directed towards a method for preparing and/or treating a fluid and/or moister absorbing basic material (1), illustrated as a textile soft material, to form an allergen or allergens impregnated material (2). It is here suggested a first processing step (S1), for the production of said absorbing basic material (a1), one or more intermediate processing steps (S2), for a sequential treatment of said basic absorbing material (1), including a first step (S2*a*) of adding one or more diluted antigen or antigens (5) to said dried absorbing basic material (1) in an extent to be fully absorbed by said material (1) and a second step (S2*b*) where said diluted antigen or antigens, within said absorbing basic material (1), and said material (1) is treated during an under-pressure sequence followed by an over-pressure sequence, or vice versa and, a final processing step (S3), where said treated absorbing material "a2", with diluted antigen or antigens (5), is dried (S3*a*) in order to form an allergen or allergens impregnated soft material (2).

21 Claims, 1 Drawing Sheet

(56) References Cited

FOREIGN PATENT DOCUMENTS

Figure 1:
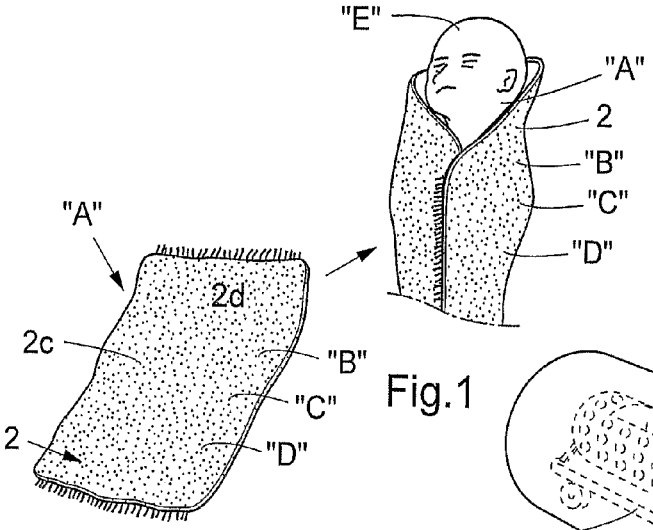

| | | | |
|---|---|---|---|
| EP | 0 891 770 | A1 | 1/1999 |
| EP | 1 353 002 | A2 | 10/2003 |
| FR | 2 375 861 | | 7/1978 |
| GB | 344414 | | 2/1931 |
| GB | 1 300 631 | | 12/1972 |
| JP | 5-188031 | A | 7/1993 |
| JP | 2004-143613 | | 5/2004 |
| WO | 98/22145 | | 5/1998 |

OTHER PUBLICATIONS

Espacenet English abstract of EP 1 353 002 A2.
English abstract of JP 2004-143613 dated May 20, 2004.
Munir, A.K.M., et al. "Exposure to indoor allergens in early infancy and sensitization." J Allergy Cun Immunol (1997) vol. 100, No. 2, pp. 177-181.
Stalldal, E. "REPORT Jan. 2004: Forskning om allergier" pp. 1-40.

* cited by examiner

METHOD FOR PREPARING A TEXTILE MATERIAL AND A TEXTILE MATERIAL THUS PREPARED AND PRODUCED

FIELD OF THE INVENTION

The present invention refers to a method for preparing and producing, by a sequential treatment in a number of processing steps, a porous material and especially an, by one or more compositions, components or compounds, impregnated such porous material.

The present invention has its application to any fluid or moister absorbing materials, however the following description is simplified in the extent that this fluid or moister absorbing porous and/or fibrous material is designated "textile material" or simply "material".

The impregnated material may be impregnated with and expose one or more dried antigen compositions, intended to be used and spread within a fibrous blanket, a tool, a dolly or the like or other similar devices, intended to be brought into a skin contact with a newborn mammal and especially a newborn child.

The present invention is especially adapted to be used in a purpose of exposing newborn children to a skin contact with such an impregnated material, such an impregnation is processed with one or more liquid diluted antigens, where the liquid has been evaporated into a dried form or as an allergen.

DEFINITIONS

Antigens: Ad usu. protein or carbohydrate substance (as a toxin, enzyme, or any of certain constituents of blood corpuscles or of other cells), that when introduced onto and/or into the body stimulates the production of antibody or antibodies.

A substance that reacts in complement fixation with an antibody to bind complement. The antigen and antibody ad usu. being specific.

Allergen: A substance that induces allergy.

Allergy: Altered bodily reactivity, as to antigen or antigens, exaggerated or pathological reaction marked by sneezing, respiratory embarrassment, itching and skin rashes, or other symptoms to substances, as germs, pollens, food, or drugs. Situations, as mental or emotional excitement or exposure to sunlight, or physical states, as coldness, that are without comparable effect on the average individuals, such as sneezing follows inhalation of pollens by persons having an allergy to them, medical practice concerned with the diagnosis and treatment of allergy.

Antigen in a liquid diluted form is, in the following description and claims, also called substance and/or substrate.

(The expression "liquid diluted" is intended to illustrate that an antigen and/or mixture of antigens have been treated to be thinner by an admixture. Said admixture is here of a form exposing high evaporation effect.)

Antigen in a dried form is an antigen in a liquid diluted form where, the liquid content has been evaporated and is, in the following description and claims, also called composition, component and/or compound and is similar to an allergen.

BACKGROUND OF THE INVENTION

The purpose of the present invention is to give advice of a method for preparing and treating a textile material and a textile material thus prepared and produced, taken into account the definition mentioned above.

The present invention is more directly adapted to a porous material, which has been treated in a wet condition and dried, to include a more or less dried, one or more, antigen substances and/or compositions, where said compositions are in excess.

It has already been recognized that for children, in the pre-scholar and scholar ages, the presence of allergic symptoms appears to have doubled since the years within 1970.

It has further been found that asthma, atopic eczema and hay-fever are the most common chronic allergic symptoms and/or illnesses among scholar children.

In Sweden it has been tested that about 16% of country living adults expose eczema or skin rash. This figure is also expected to be the same in other countries.

When adults in Sweden today are asked the question; whether they suffer from a running, itchy nose or eyes in connection with leaf budding, grass flowering or by contact with furry animals, more than 18% feel that this disadvantageous more or less affects them to a notable extent or degree.

It has also been observed, by tests, that when newborn children, immediately after the childbirth, have been injected with and/or exposed to one or more antigens, in a certain concentration, they adopt to and develop a properly operating immune system and thereby tend to maintain a healthy "status quo" during their lifetime in this respect.

In a Swedish publication "ALLERGI" by Nils E. Eriksson (ISBN 91-44-35 791-5), pages 304 to 308, it is shown in a diagram that exposed hypo-sensibilization (IgE) is extremely high for a newborn child and is thereafter illustrated in said diagram as a decreasing function with time.

It has further been evaluated that one or more antigens, in different forms and solutions, may be used within one or more of the categories mentioned below;

a. in the form of an injection liquid,
b. in the form of tablets or pastilles,
c. in the form of a drinkable liquid mixture,
d. in the form of a solution for spraying,
e. in the form of substances adapted for inhalation,
f. in the form of a jelly consistency, applied towards a chosen skin part and/or
g. in the form of a dried fibrous material, with one or more antigen substances dried to antigen components or allergens, intended for a physical contact with the body of an infant mammal or a child.

The present invention has its application especially directed to the conditions reflected under subsection or category "g" above.

It has also been found that the concentration of, the amount of and the type of used antigen or antigens, in each of the above different applications and categories, are related to the used application, categorized as "a" to "g" above, and the mammal or the child or person involved in order to develop a proper immune defense system.

The concentration of, the amount of and the type of used antigen or antigens, related to each of the categories "a" to "g" above, have been investigated in detail and it is previously known many investigations and tests, the results of which have been published in many different publications.

In the International patent application PCT/US97/21 687, or patent publication WO-A1-98/22 145, it is shown and described methods and compositions which may be used to immunize infant mammals or children against one or more target antigens and/or thereto related allergens.

It is here suggested that the immunogenically effective amount of a nucleic acid, encoding a relevant epitope of a desired target antigen, is administrated to an infant child.

Based, at least in part, on the discovery that such genetic immunization of infant mammals could give rise to effective cellular and humoral immune responses and defenses against target antigens, the present invention founds its application in a fibrous soft material, illustrated as a textile material.

The introduction of an antigen and a solution thereof is here proposed to be effected by an "injection" process, as stated under subsection or category "a" above.

In the European Patent Application EP-A1-0 451 800 it is described and illustrated a method, for a diagnostic purpose only, for producing a binding assay device, composed of antigens on a cellulose nitrate, cellulose nitrate/acetate or similar solid phase material or structure.

This method involves applying, to a solid phase, a small amount of an antigen substance, or a pretreated allergen composition, containing a certain concentration of an antigen and drying the solution in order to form an allergen and/or allergens.

This method is used by contacting a patient test sample to the immobilized allergen and determining whether or not the test sample contains IgE antibodies related to a chosen antigen or allergen.

This publication discloses a discovery that an allergen solution (antigen in a liquid form) can be used to bind an allergen to a solid phase material, without any need for covalent linkage.

A solid phase thus prepared can then be used in an "in vitro" diagnostic assay, for the evaluation of the amount of IgE.

It is also suggested that suitable solid phase materials may include cellulose nitrate or mixed ester cellulose.

In addition, it has been discovered that certain allergen concentrations (antigens in dried form) are exposing optimum related results, insofar as the sensibility of the assay is concerned.

Considering the basic idea of the present invention it is to be mentioned that it is previously known to introduce a liquidized antigen into a solution, and to immerge a textile material in said solution and than dry said textile material, to form a solid phase or state, when the liquid (such as alcohol) is evaporated and a dried antigen is exposed within said textile material.

Taking into account some of the significant features related to the present method it is to be mentioned that means and/or arrangements for causing sequential under-pressure and over-pressure processing steps are used in plants for producing impregnated tree materials, for a sequentially suction and pressing an impregnated liquid into the fibers of such a solid tree material, for exposing a resistance towards water and moisture during extended time sequences.

Such a plant includes an autoclave arrangement where the tree material is trans-ported into a cylinder-formed space, which is closed, and the solid tree material is subject to a pre under-pressure step, an over-pressure step, a final post under-pressure step for a final treatment of the solid tree material, such as planks, deals and/or battens.

TECHNICAL CONSIDERATIONS RELATED TO THE PRESENT INVENTION

Technical Problems

When taking into consideration the technical deliberations that a person skilled in this particular art must make in order to provide a solution to one or more technical problems that he/she encounters, it will be apparent that it is necessary initially to realize, on the one hand, the measures and/or the sequence of measures that must be undertaken to this end, and to realize, on the other hand, which means is/are required in solving one or more of said problems. On this basis, it will be evident that the technical problems listed below are highly relevant to the development of this invention.

Under consideration of the state of the art, as described above, it should therefore probably be seen as a technical problem to be able to realize the importance of, the advantages associated with and/or the technical measures and considerations which will be required in order to expose, to one or more newborn infant mammals or children, one or more targeted antigens in the form one or more antigens in a liquid diluted form, evaporating said liquid to form one or more dried antigens or allergens, either by inhalation or by a physical skin contact, such as via an antigen treated soft fibrous material, containing said one or more allergens and/or antigen or antigens compositions, components and/or compounds.

Under consideration of the state of the art, as described above, it should therefore probably be seen as a technical problem to be able to realize the importance of, the advantages associated with and/or the technical measures and considerations which will be required in order to, based upon a method for preparing and/or treating a fluid and/or moister absorbing basic material, illustrated as a textile material, to form an allergen and/or allergens impregnated material, and to impose a coding of the immune defense system, such as causing an active immunization and/or a hypo-sensibilization.

Under consideration of the state of the art, as described above, it should therefore probably be seen as a technical problem to be able to realize the importance of, the advantages associated with and/or the technical measures and considerations which will be required in order to causing a method, based upon an arrangement of exposing; a first processing step, for the production of a liquid absorbing basic material, one or more intermediate processing steps, for a sequential treatment of a dried basic absorbing material, including a first step of adding one or more diluted antigen or antigens to said absorbing basic material in an extent to be fully absorbed by said basic material and a second step where said diluted antigen or antigens, within said absorbing basic material, and said liquid absorbed basic material is treated during an under-pressure sequence, followed by an over-pressure sequence, or repeated treatments or vice versa and, a final processing step, for drying said treated absorbing material with liquid diluted antigen or antigens, in order to form an antigen or antigens (allergen or allergens) impregnated soft material.

Under consideration of the state of the art, as described above, it should therefore probably be seen as a technical problem to be able to realize the importance of, the advantages associated with and/or the technical measures and considerations which will be required where said first processing step includes; a first step of producing an liquid absorbing material, exposing a required concentration of and/or shape of pores or other interstices, adapted to be able to enclose and/or contain said liquid antigen substance, during a chosen under-pressure step.

Under consideration of the state of the art, as described above, it should therefore probably be seen as a technical problem to be able to realize the importance of, the advantages associated with and/or the technical measures and considerations which will be required where said first processing step includes; a second step of washing said produced absorbing material to cleanse it from one or more impurities, caused during said first steps of producing a liquid absorbing material.

It is to be considered as a technical problem to be able to realize the importance of, the advantages associated with and/or the technical measures and consideration which will be required when a washing clean effect, within said second step, is caused by using a liquid, such as water and/or alcohol, and/or added one or more detergents, under a high temperature, such as between 80°-100° C. when only water is used.

It is to be considered as a technical problem to be able to realize the importance of, the advantages associated with and/or the technical measures and consideration which will be required when said washed liquid absorbing material is caused to slowly dry, towards a temperature of 18° to 25° C.

It is to be considered as a technical problem to be able to realize the importance of, the advantages associated with and/or the technical measures and consideration which will be required when said liquid absorbing material is, within said first processing step, washed clean from oil or other similar impurities by a rotating sequence or the like of said material.

It is to be considered as a technical problem to be able to realize the importance of, the advantages associated with and/or the technical measures and consideration which will be required when, said step of washing clean includes alcohol or similar liquid diluted form, as substance and/or substrate and/or appropriated detergents, for washing away any stitching oil including impurities or the like.

It is to be considered as a technical problem to be able to realize the importance of, the advantages associated with and/or the technical measures and consideration which will be required when said first processing step is, during said washing clean process, causing and forming a pore structure of said material, that its porous openings and/or interstices are adapted for a later treatment within an intermediate processing step to facilitate appropriate adhering towards and enclosing one or more liquid diluted antigen substances or substrates.

It is to be considered as a technical problem to be able to realize the importance of, the advantages associated with and/or the technical measures and consideration which will be required when said diluted antigen substances or substrates contains alcohol, or the like, in excess.

It is to be considered as a technical problem to be able to realize the importance of, the advantages associated with and/or the technical measures and consideration which will be required when a mixture of said one or more antigen substances and/or substrates with a used liquid, alternative composition, component and/or compound, and the porous material within said intermediate step is carried out in a slow running mixing device and/or during an under-pressure, such as a using a rotating drum arrangement, such as oriented within an autoclave arrangement.

It is to be considered as a technical problem to be able to realize the importance of, the advantages associated with and/or the technical measures and consideration which will be required when during a second drying process within said intermediate step, such as a centrifugation within a drum arrangement, an excess part or portion of said one or more antigen substances or substrates are re-circulated.

It is to be considered as a technical problem to be able to realize the importance of, the advantages associated with and/or the technical measures and consideration which will be required when said intermediate processing step includes an autoclave arrangement, for causing; a combined under-pressure and over-pressure chamber arrangement.

It is to be considered as a technical problem to be able to realize the importance of, the advantages associated with and/or the technical measures and consideration which will be required when an under-pressure processing step is activated during a first time period and this time period is succeeded with an over-pressure processing step, activated during a second time period, for causing a pumping effect related to said diluted antigen substances into said pores.

It is to be considered as a technical problem to be able to realize the importance of, the advantages associated with and/or the technical measures and consideration which will be required when said treated basic material, within said intermediate processing step, is, within a final processing step, subject to a final sterilization process, such as a third drying effect, in the form of a dry freezing and/or UV- or IR-treating process.

It is to be considered as a technical problem to be able to realize the importance of, the advantages associated with and/or the technical measures and consideration which will be required when said dry freezing process is activated during a chosen time duration, such as 48 hours, within a predetermined (constant) temperature, such as −20° C., to form said antigen or allergen impregnated and sterilized soft material.

It is to be considered as a technical problem to be able to realize the importance of, the advantages associated with and/or the technical measures and consideration which will be required when said produced impregnated and sterilized material is used as separate discrete material sections, as blankets, or as a movable belt or web structure or the like.

The present invention also covers an allergen and/or allergens impregnated and/or sterilized material, produced in accordance to any of the succeeding method claims.

It is to be considered as a technical problem to be able to realize the importance of, the advantages associated with and/or the technical measures and consideration which will be required when said material is impregnated with one or more antigens or allergens especially in the form of animal epithelium and plant pollen, with the intention or view of being skin exposed to a newborn child, when its immune-sensitization commences.

It is to be considered as a technical problem to be able to realize the importance of, the advantages associated with and/or the technical measures and consideration, which will be required for a novel use of a textile, impregnated with one or more allergens, soft material, intended to surround a newborn child and during a period of time when immune-sensitization commences, by creating a primary immunological tolerance in said newborn child, as said allergen, of an animal epithelium and/or plant pollen, in a textile material is to be surrounding a child within 36 hours from the commencement of immune-sensitization, and that said antigen or allergen is supplied to said textile, in the form of a blanket or handkerchief, after washing away any knitting or stitching oil and by thereafter causing it to pass through an impregnation solution, containing antigens and/or allergens before a final drying process.

It is to be considered as a technical problem to be able to realize the importance of, the advantages associated with and/or the technical measures and consideration which will be required when the textile material is formed into a so called cuddly animal or cuddly pet and filled with an appropriate impregnating-padding.

Solutions

In this instance, the present invention takes as its point of concept or departure the prior art technology, as disclosed by way of introduction, relating to a method for preparing and/or treating a fluid and/or moister absorbing basic material, illustrated as a textile material, to form an allergen and/or allergens impregnated material, by arranging in a sequential order;

a. a first processing step, for the production of a liquid absorbing basic material, exposing to ambient air opened pores, b. one or more intermediate processing steps, for a sequential treatment of a dried liquid absorbing basic material, including a first step of adding one or more diluted antigen or antigens to said dried absorbing basic material, in an extent to be fully absorbed by said basic material, and a second step where said diluted antigen or antigens, within pores in said liquid absorbing basic material, and said basic material is treated during an under-pressure sequence, for a suction sequence and for entering still more antigen and/or antigens into the pores, followed by an over-pressure sequence, causing a pumping effect of said antigen or antigens into said pores or vice versa and, c. a final processing step, for drying said treated liquid absorbing material, according to "b" above, with diluted antigen or antigens, in order to form an antigen or antigens and/or allergen or allergens impregnated and/or sterilized soft liquid absorbing material.

The present invention also gives advice of steps where said first processing step includes; a first step of producing an liquid and/or antigen in pores absorbing basic material, exposing pre-required dimensions and distributions or density of required pores and/or other interstices.

Said first processing step includes; a second step of washing said liquid absorbing basic material to cleanse it from impurities, caused during said first steps of producing.

A washing clean effect, within a second step, is caused by using appropriate liquid, and/or adding one or more, detergents under a high temperature, such as between 80°-100° C. when water in excess is used as liquid.

Said washed and hot material is then caused to dry, towards a temperature of say 18° to 25° C., in a first drying step.

Said basic material is, within said first processing step, and in said second step washed clean from oil or other similar impurities.

Said step of washing clean includes water and detergents for washing away any stitching oil including impurities or the like, at a dried condition, to empty the formed pores from said impurities.

Said first processing step is, during said washing clean process, within said second step causing and forming a structure of said basic material that, at a dried condition, its pores, openings and/or interstices are adapted for an adhering effect towards one or more later added liquid diluted antigen substances or substrates, within said intermediate processing step.

Moreover the substances or substrates may contain a mixture of antigen and/or antigens and alcohol, or the like, in excess.

A mixture of said one or more antigen substances or substrates with a used liquid, alternative composition, component and or compound, within said intermediate step with a dried basic absorbing material, is carried out in a mixing device, such as a slow running rotating drum arrangement.

During a second drying process within said intermediate step, such as a centrifugation within a drum arrangement, an excess part or portion of said one or more antigen substances or substrates are re-circulated.

Said intermediate processing step includes; a combined under-pressure and over-pressure chamber arrangement or autoclave arrangement, where an under-pressure processing step is activated during a first time period, and this time period is instantly succeeded by an over-pressure processing step activated during a second time period.

Said treated basic material, within said intermediate processing step, is within a final processing step subject to a final drying and/or sterilization process, such as a dry freezing and/or UV- and/or IR-treating process.

Said dry freezing process is activated during chosen time duration, such as 48 hours, within a predetermined (constant) temperature, such as −20° C., to form said allergen impregnated and sterilized soft material.

As said produced impregnated and sterilized soft material is a used separate discrete material section and/or a movable belt or web section or structure or the like.

The present invention also covers a prepared and dry treated absorbing material having dried allergen and/or allergens impregnated therein and produced according to any of the succeeding method claims.

A prepared and dry treated material is here impregnated with one or more allergens, especially in the form of animal epithelium and plant pollen, with the intention or view of being skin exposed to a newborn child, when its immune-sensitization commences.

The invention also covers a novel use of an sterilized textile, impregnated with one or more allergens, soft material, intended to surround a newborn child and during a period of time when immune-sensitization commences, by creating a primary immunological tolerance in said newborn child, as said allergen, of an animal epithelium and/or plant pollen, in a soft textile material is to be surrounded a child within 36 hours from the commencement of immune-sensitization. Said antigen or allergen is supplied to said textile, in the form of a blanket or handkerchief, after washing away any knitting or stitching oil and by thereafter causing it to pass through an additional impregnation solution, containing antigens in liquid form.

The textile material is formed into a so called cuddly animal or cuddly pet and filled with an appropriate padding.

Advantages

The advantages which may principally be deemed to be characteristic of the pre-sent invention and the specific significative characterizing features disclosed thereby is a method for preparing and/or treating a fluid and/or moister absorbing basic material, illustrated as a textile material, to form an allergen and/or allergens impregnated dry and soft material.

The present invention also covers a textile material produced or treated according to the different aspects related to the present invention.

With a liquid diluted antigen is mixed with a dried porous textile basic material and treated by an under-pressure step, such as a pressure down to −0.9 bar, and succeeded by an over-pressure step, such as a pressure up to +13 bar, whereby the two different pressure steps may be caused by simply reversing the revolution of a vacuum or a pressure pump arrangement connected to an autoclave.

The most significative features related to a method, according to the present invention, and an antigen substance or substrate spread and/or distributed within a liquid absorbing soft textile material, produced in accordance of the inventive method, are disclosed in the characterizing part of the accompanying claim 1 and in the accompanying claim 17.

BRIEF DESCRIPTION OF THE FIGURES SHOWN IN THE ENCLOSED DRAWINGS

Figure 4:
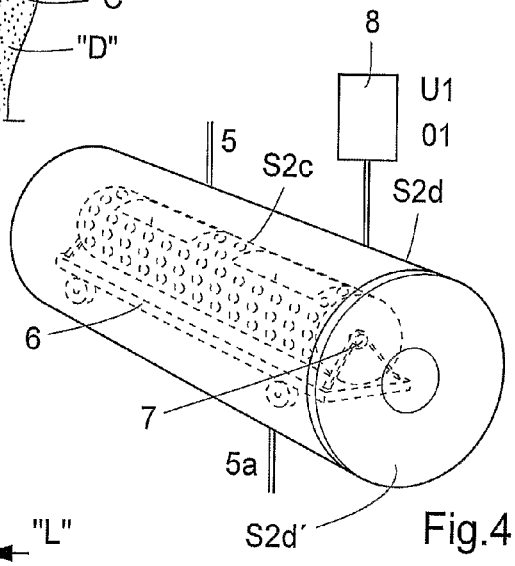
Figure 2:
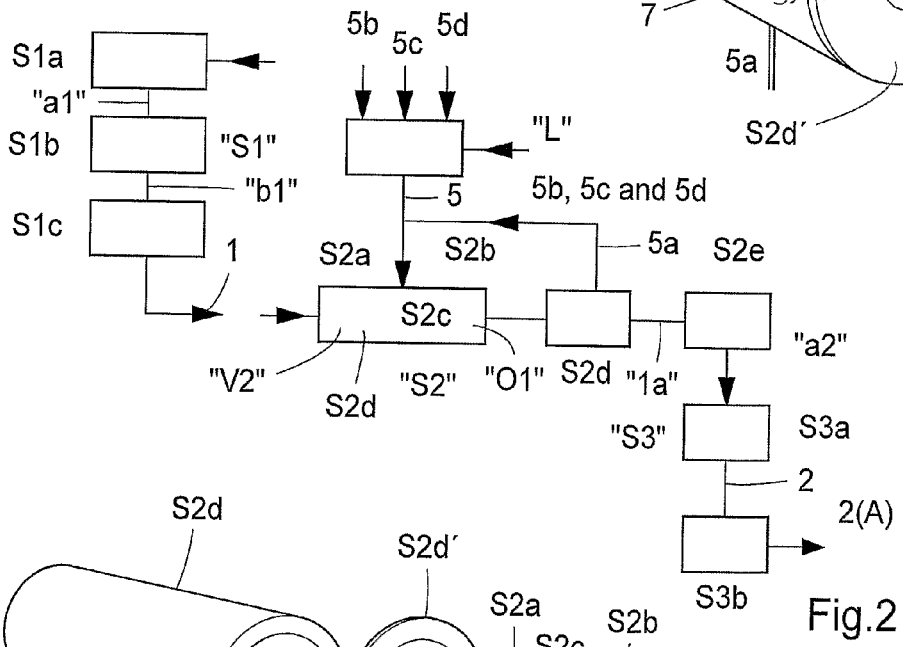
Figure 3:
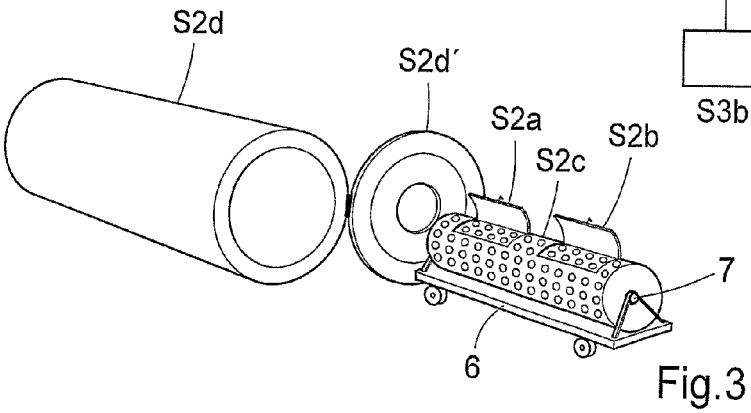

The significative features related to the present invention, related to a method of treating, preparing and producing a textile material and a textile material thus produced, will, as a single exemplified embodiment, be apparent from the following description, when reference is made to the attached figures, in which;

FIG. 1 is showing in a perspective view an antigen and/or allergen impregnated soft textile material sample, in the form of a blanket, adapted to be wrapped, as also shown in FIG. 1, around an infant child, preferably immediately or a short time after its childbirth, FIG. 2 is showing, in a block schema, the different preparing and producing steps to be taken in order to produce, from a produced textile material sample, such a blanket, adapted to be used to more or less immunize an infant child against one or more target antigens and/or allergens, distributed in a dried condition as compositions, components and/or compounds in said textile soft material sample, FIG. 3 is illustrating an embodiment, usable within an intermediate processing step, showing an autoclave arrangement and an opened autoclave door and a drum or cylinders shaped washing an treating arrangement orientated outside said autoclave arrangement for preparing the sequential treatment process within the intermediate processing step and FIG. 4. is illustrating the embodiment, as shown in FIG. 3, where said drum or cylinder shaped washing and treating arrangement is enclosed in an airtight and closed autoclave arrangement with a closed autoclave door.

DETAILED DESCRIPTION OF A PREFERRED EMBODIMENT EXPOSING THE SIGNIFICATIVE FEATURES RELATED TO THE PRESENT INVENTION

It is pointed out initially that we have chosen to use, in the following description of an embodiment at present preferred and that includes, the significant characteristic features of the present invention, as illustrated in the figures of the accompanying drawings, special terms and terminology with the primary intention of illustrating the inventive concept more clearly.

However, it will be noted that the expressions chosen here shall not be limited solely to the chosen terms used in the description and claims but that each term shall be interpreted as also including all technical equivalents that function in the same or essentially the same purpose and/or reaching the intended technical effect.

The present invention is based upon a method, for preparing and/or treating a fluid and/or moister absorbing basic material 1, illustrated as a soft, dried textile material, to form an allergen or allergens impregnated material 2, an impregnated textile material "A", wherein the material is impregnated with one or more dried antigens to allergens, designated "B", "C" or "D" in the form of compositions, components and/or compounds and based upon a method for sequentially producing preparing and/or treating such a basic textile material 1.

The present invention is based upon a method, according to FIG. 2, illustrating a first processing step "S1", for the production of said liquid absorbing basic material 1, one or more intermediate processing steps "S2", for a sequential treatment of said liquid absorbing basic material 1, including a first step "S2*a*" of adding one or more diluted antigen or antigens 5*b*, 5*c* and 5*d* to said absorbing basic material 1 in an extent to be completely absorbed by said basic material 1 and a second step "S2*b*" where said diluted antigen or antigens 5*b*, 5*c* and 5*d*, within said absorbing basic material 1, and said basic material 1 is treated during one or more under-pressure sequences "U1" followed by one or more over-pressure sequences "O1", or vice versa and, a final processing step "S3" where said treated absorbing material, with diluted antigen or antigens, is dried in order to form an antigen or antigens and/or allergen or allergens impregnated soft material 2.

The present invention discloses, as its first processing step "S1", the use of a first step "S1*a*" of producing a liquid absorbent porous material "a1", exposing pre-required pores, pore forms and/or densities, and/or other interstices and other similar structures for improving the capacity of absorbing liquid and in a dry state keep antigens and/or allergens in dried form even after a long time of frequent use and after repeated washing in washing machines.

Said first processing step "S1" also includes a second step "S1*b*" of washing said absorbent material "a1".

In step "S1*b*", the intension is to cleanse the material "a1" from impurities, caused during said first step "S1*a*" of producing and which impurities may be enclosed in the opened and/or more or less closed pores of different sizes and/or other interstices.

A washing clean effect, within a second step "S1*b*", may be caused by using water, and added one or more, petroleum substances cleaning detergents under a high water temperature, such as between 80°-100° C.

Said washing clean effect in the second step "S1*b*" may use other liquid and/or mixture of liquids and/or temperatures, all for the purpose of effectively cleaning the pores and the material "a1" completely from impurities.

Said washed material "b1" is caused to dry, towards a temperature of 180 to 250° C. in a further step, denoted a first drying step "S1*c*", during a long time for a slow evaporation process.

Said material is, within said first processing step "S1" and its second step "S1*b*", washed clean from oil and/or other similar impurities, said step "S1*b*" of washing clean may advantageous include hot water diluted with detergents, for washing away any stitching oil including impurities or the like and opening any closed pores and forming a soft outer surface adapted to be exposed towards the skin of an infant newborn child.

Said first processing step "S1" is, during a sequential combination of the material producing step or process "S1*a*", the washing clean step or process "S1*b*" and the first drying step or process "S1*c*", causing and forming a structure of a produced material 1, where its pores, its openings and/or its interstices are adapted for adhering towards one or more liquid diluted antigen substances or substrates and/or dry allergen and/or allergens within a succeeding intermediate processing step "S2" and/or a final processing step "S3".

The intermediate processing step "S2", includes loading a machine arrangement with prepared and dried basic material 1, causing an under-pressure sequence "U1" followed by an over-pressure sequence "O1" within an autoclave, as mentioned above, for a sequential treatment of the textile material 1, when it is introduced into said intermediate step "S2".

Said diluted antigen substances or substrates 5*b*, 5*c* and 5*d* in a mixture 5 may contain said antigen and/or antigens and/or allergen or allergens in a predetermined concentration, however with a mixture of alcohol or the like in excess, before the mixture 5 and the added alcohol "L" is transported or delivered towards the dried material 1, received an packed in the intermediate step "S2".

A mixture of said one or more antigen substances or substrates 5*b*, 5*c* and 5*d* with a used liquid "L", alternative composition, component and or compound, is carried out in an autoclave "S2*d*" and a mixing device "S2*a*", such as a slowly rotating drum arrangement "S2*c*".

During a second drying process (different from the first drying step S1*c*), such as a centrifugation "S2*b*" within said drum arrangement "S2*c*", an excess part or portion of said one or more antigen substances or substrates 5*b*, 5*c* and/or 5*d* are re-circulated, as a mixture 5 through a conduit 5*a*.

Said intermediate processing step "S2" includes; a combined under- and over-pressure chamber arrangement or said autoclave S2*d*.

An under-pressure processing step "U1" is activated during a first time period "t1" and this time period is succeeded with an over-pressure processing step "O1" activated during a second time period "t2", all steps are processed within said drum arrangement S2*c* and the autoclave S2*d* when the door S2*d'* is closed, as seen in FIG. 4.

The time period "t1" is to be evaluated in dependence of the material 1 structure used, the antigen substance 5 used, the concentration of and the liquid "L" used, the pore structures and/or the under-pressure used.

It has been found that the under-pressure is normally to be as low as possible, however at least lower that −0.7 bar in this application.

The time period "t2" is to be evaluated in dependence of the material 1 structure used, the antigen substance 5 used, the concentration of and the liquid "L" used, the pore structures and/or the over-pressure used.

It has been found that the over-pressure is normally to be as high as possible, however at least over +10 bar in this application.

The durations of times "t1" and "t2" may be varied within large time sectors.

It is here possible to cause a "pumping effect" of the antigen in a liquid diluted form into the pores of the material 1 by choosing the durations of time short, say 1 to 10 seconds, and terminating this treatment with an over-pressure step, during a longer time period.

It is also proposed, according to the present invention, to cause a single under-pressure step within the autoclave S2*d* during a time period "t1" of 30 minutes, at −0.9 bar under a slowly (equal to a washing machine rotating for washing purposes) rotation of the dried material 1 and thereto added antigen substances 5*b*, 5*c* and 5*d*.

The antigen substances are diluted and added in a quantity enough for completely moistening the dried material 1 and to assure that as many pores as possible are filled with antigen substances.

An excess part or portion of said one or more antigen substances or substrates 5*b*, 5*c*, 5*d*, may be re-circulated as a mixture 5 through said conduit 5*a*.

It is also proposed, according to the present invention, to cause a single over-pressure step within the autoclave S2*d* during a time period "t2" of 45 minutes, at +13 bar under a slowly (equal to a washing machine rotating for washing purposes.) rotation of the material 1 and thereto added and mixed antigen substances 5*b*, 5*c* and 5*d*.

The antigen substances are diluted and added in a quantity enough for completely moistening the dried material 1 and to assure that as many pores as possible are additionally filled with antigen substances during this over-pressure step.

The overflow of antigen substances is extracted, during a slow rotation, and now transported (via a conduit 5*a*) to a container (not shown) for a later and repeated use.

It is now suggested that the drum arrangement S2*c* is activated to a fast rotational speed (equal to a washing machine rotating for centrifugal purposes.) and that the overflow of antigen substances is once again extracted, during said fast rotation, and now transported (via conduit 5*a*) to a container (not shown) for a later and repeated use.

This material "1*a*", partly dried, thus produced may be subject to a further final drying step S2*e*.

Said treated dried material "1*a*", within said intermediate processing step "S2", is within said final processing step "S3" subject to a final sterilization process "S3*a*", such as a dry freezing and/or UV- or IR"-treating process.

Said dry freezing process "S3*a*" is activated during a chosen time duration, such as 48 hours, within a predetermined temperature, such as −20° C., to form said allergen impregnated material 2 ("A").

The treated material "a2" may be hanging free within said dry freezing process S3*a*.

As said produced impregnated material 2 is used, separate discrete material sections, as shown in FIG. 1, or a movable belt or web structure or the like, intended to be cut in smaller pieces in a final processing step.

The final material 2 is in FIG. 2 illustrated to be stored in a final step "S3*b*".

The present invention also covers a prepared and dry, treated absorbing material 2 ("A") having dried allergen and/or allergens impregnated therein, produced according to any of the succeed method claims.

Said material 2 is impregnated with one or more allergens, especially in the form of animal epithelium and plant pollen, with the intention or view of being skin exposed to a newborn child "E", when its immune-sensitization commences.

A novel use of a textile, impregnated with one or more allergens, soft material "A" intended to surround a newborn child "E" and during a period of time when immune-sensitization commences, by creating a primary immunological tolerance in said newborn child, as said allergen, of an animal epithelium and/or plant pollen, in a textile soft material is to be surrounding a child within 36 hours from the commencement of immune-sensitization, and that said antigen or allergen is supplied to said textile, in the form of a blanket or handkerchief, after washing away any knitting or stitching oil and by thereafter causing it to pass through an additional impregnation solution, containing antigens before a final drying process.

The textile material is formed into a so called cuddly animal or cuddly pet and filled with an appropriate padding.

It is further to be considered that the mixture of antigen or antigens in liquid form may be added to the dried material 1 in a sequential form, to add said liquid in sequence parties during or without said under pressure step and/or during or without said over pressure step.

The drum arrangement S2*c* is supported by a wagon arrangement 6 and means 7 for rotating said arrangement 6 in selected different rotational speeds, in addition to the two speeds mentioned above.

We have mentioned the use of an autoclave arrangement S2*d* with a door arrangement S2*d'*.

This is to be significant for an airtight chamber that can be subject to an over pressure step "O1" as well as to an under pressure step "U1", here caused by a pump arrangement 8, causing an under pressure at one rotational direction and an over pressure at another equal (different) rotational direction.

As mentioned above the concentration of the antigen (or allergen) dilution may fall within different values depending upon the antigen or allergen used.

We have found that 80% alcohol (ethanol) and 20% allergen or antigen is a basic concentration. However the ratio may fall within the concentrations 90/10 to 40/60.

The ethanol content may be substituted by other alcohols however the amount alcohol must be sufficient for its fat neutralization property and that it may fully fill the pores in the textile material.

Water and alcohol may be used in a mixture in stead of pure alcohol.

An alternative to the described embodiment above is a plant where the allergy solution is stored in a tub oriented directly under an under-pressure chamber, in which tub a conduit is under the upper surface, said conduit is terminating 10 cm from the bottom.

This conduit is closed by a valve arrangement during the under-pressure step, during 20 to 40 min.

At the end of this step the valve arrangement is turned to an open position and the under-pressure step sucks the allergy solution into the materiel stored in this chamber and into the pores, subject to an under-pressure condition.

When the material is "completely" covered by said solution the valve arrangement is turned to its closed position, the under-pressure pump arrangement is caused to a counter-wise rotation and is then producing an over-pressure step to an over-pressure as high as possible, say +10 to 20 bar or +10 to 15 bar during a time duration of 30 to 60 minutes, such as 40 to 50 minutes.

In summary:

a. The drum arrangement is filled with dry textile blankets and hermetically closed.

b. The under-pressure step, at −0.9 bar, at 30 minutes is caused during a slow rotation sequence.

c. Fill up the drum arrangement with antigen and/or antigens and/or allergen and/or allergens containing solution during a slow rotation speed.

d. Treatment of the textile material in an over-pressure step, such as +13 bar during 45 minutes at a slow rotating speed.

e. Open the valve arrangement and drain the antigen or allergen containing solution at a slow rotating speed to said tub.

f. Causing the drum arrangement to rotate in a centrifugation step at a high rotation speed during 5 to 15 minutes.

g. Take the treated textile material out of said drum arrangement and let the blankets dry in a dry-freezing step.

The invention is not restricted to the shown and described embodiment but may be amended within the scope of the invention as it is stated in the following claims.

The invention claimed is:

1. A method or process for preparing and/or treating a fluid and/or moister absorbing basic material (1), illustrated as a textile material, to form an antigen and/or antigens and/or allergen and/or allergens impregnated soft material (2), characterized in using, a. a first processing step (S1), for the production of said absorbing basic material (1) having ambient air opened pores, b. one or more intermediate processing steps (S2), for a sequential treatment of said basic absorbing material (1), including:

a first step (S2*a*) of adding one or more solutions, including diluted antigen and/or antigens (5*b*, 5*c*, 5*d*) and/or allergen and/or allergens, to said absorbing basic material (1) in an extent and a structure to be more or less completely absorbed by said basic material (1); and a second step (S2*b*) where said diluted antigen (5*b*, 5*c*, 5*d*) and/or antigens and/or allergen and/or allergens, within said absorbing basic material (1), and said basic material (1) is treated during an under-pressure sequence or step (U1), whereby diluted antigen (5*b*, 5*c*, 5*d*) and/or antigens and/or allergen and/or allergens is sucked into the pores of said absorbing basic material (1), the under-pressure sequence or step (U1) being followed by an over-pressure sequence or step (O1), whereby diluted antigen (5*b*, 5*c*, 5*d*) and/or antigens and/or allergen and/or allergens is pumped into the pores of said absorbing basic material (1), or vice versa and, c. a final processing step (S3), where said treated absorbing material, according to "b" above, with said diluted solution, is dried in order to form an impregnated soft material (2).

2. The method as claimed in claim 1, characterized in that, said first processing step (S1) includes; a first step of producing an absorbing soft material, exposing required pores and/or other interstices.

3. The method as claimed in claim 2, characterized in that, said first processing step includes; a second step of washing said absorbing basic material to cleanse it form impurities, caused during said first steps of producing.

4. The method as claimed in claim 1, characterized in that, a washing clean effect, within said second step, is caused by using a liquid or a mixture of liquids, and/or added one or more, detergents, under a high temperature, such as between 80°-100° C., when using water.

5. The method as claimed in claim 3, characterized in that, said washed material is caused to dry, towards a temperature of 18° to 25° C.

6. The method as claimed in claim 1, characterized in that, said material is, within said first processing step, washed clean from oil or other similar impurities.

7. The method as claimed in claim 6, characterized in that, said step of washing clean includes water and detergents, for washing away any stitching oil including impurities or the like.

8. The method as claimed in claim 1, characterized in that, said first processing step is, during a washing clean process, causing and forming a structure of said material that its pores, its openings and/or its interstices, are adapted for a later adhering towards one or more liquid diluted antigen substances or substrates and/or allergen and/or allergens, within said intermediate processing step.

9. The as claimed in claim 8, characterized in that, said diluted antigen substances or substrates contains alcohol or the like in excess.

10. The method as claimed in claim 8, characterized in that, a mixture of said one or more antigen substances or substrates with a used liquid, alternative composition, component and or compound, is carried out in a rotating drum arrangement.

11. The method as claimed in claims 8, 9, or 10, characterized in that, during a first drying process, within said intermediate processing step, of a centrifugation within a drum arrangement, an excess part or portion of said one or more antigen substances or substrates are re-circulated.

12. The method as claimed in claim 1, characterized in that, said intermediate processing step includes; a combined under-pressure and over-pressure chamber arrangement in the form of an autoclave arrangement.

13. The method as claimed in claim 1, characterized in that, an under-pressure processing step provides an under-pressure lower than −0.7 bar is activated during a first time period and in that this time period is succeeded with an over-pressure processing step providing an over-pressure higher than +10 bar activated during a second time period.

14. The method as claimed in claim 1, characterized in that, said treated basic material, within said intermediate processing step, is within said final processing step subject to a final sterilization process, which is a dry freezing and/or UV- or IR-treatment process.

15. The method as claimed in claim 14, characterized in that, said dry freezing process is activated during a chosen time duration, 48 hours, within a predetermined temperature, −20° C., to form said allergen impregnated material.

16. The method as claimed in claim 1, characterized in that, as said produced impregnated material is used, separate discrete material sections or a movable belt or web structure or the like.

17. The treated absorbing material, having or exposing dried antigen and/or antigens and/or allergen and/or allergens impregnated therein, produced according to claim 1.

18. The treated material, as claimed in claim 17, characterized in that, said material is impregnated with one or more allergens in the form of animal epithelium and plant pollen, with the intention or view of being skin exposed to a newborn child, when its immune-sensitization commences.

19. The treated material, as claimed in claim 17, characterized in a novel use of a soft textile material, impregnated with one or more antigen and/or antigens and/or allergen and/or allergens, said material intended to surround a newborn child and during a period of time when its immune-sensitization commences, by creating a primary immunological tolerance in said newborn child, as said allergen, in that said soft a textile material is to be surrounding a child, immediately or a short time after its childbirth, at a skin contact at within 36 hours from the commencement of immune-sensitization, and that said antigen or allergen is supplied to said soft textile material, in the form of a blanket or handkerchief, after washing away any knitting or stitching oil and by thereafter causing it to pass through an impregnation solution, containing antigens, before a final drying process.

20. The treated textile material as claimed in claim claim 17, characterized in that, said soft the textile soft material is formed into a so called cuddly animal or cuddly pet, and filled with an appropriate padding.

21. The treated material, as claimed in claim 19, characterized in that, said allergen, is an animal epithelium and/or plant pollen.

* * * * *